US009580885B2

(12) United States Patent
Wu et al.

(10) Patent No.: US 9,580,885 B2
(45) Date of Patent: Feb. 28, 2017

(54) SWING OPERATING MACHINE AND METHOD OF CONTROLLING SWING OPERATING MACHINE

(75) Inventors: Chunnan Wu, Yokosuka (JP); Shipeng Li, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 154 days.

(21) Appl. No.: 14/352,745

(22) PCT Filed: Oct. 19, 2011

(86) PCT No.: PCT/JP2011/005836

§ 371 (c)(1),
(2), (4) Date: Apr. 18, 2014

(87) PCT Pub. No.: WO2013/057758

PCT Pub. Date: Apr. 25, 2013

(65) Prior Publication Data

US 2014/0257647 A1 Sep. 11, 2014

(51) Int. Cl.
*E02F 9/12* (2006.01)
*E02F 9/20* (2006.01)
(Continued)

(52) U.S. Cl.
CPC ..... *E02F 9/123* (2013.01); *E02F 3/435* (2013.01); *E02F 9/2033* (2013.01);
(Continued)

(58) Field of Classification Search
CPC ..... E02F 9/24; E02F 9/2033; E02F 9/2054; E02F 3/435; E02F 9/123; E02F 9/265
See application file for complete search history.

(56) References Cited

U.S. PATENT DOCUMENTS 6,114,993 A * 9/2000 Henderson ..... G01C 21/00 342/357.27
6,230,090 B1 * 5/2001 Takahashi ..... E02F 3/435 212/280
(Continued)

FOREIGN PATENT DOCUMENTS

JP 05-321304 A 12/1993
JP 05-331882 A 12/1993
(Continued)

OTHER PUBLICATIONS

Huiping Shen et al., "Structural conceptual optimization and kinematics of a 3-Dof novel parallel mechanism used for virtual axes coordinate measure machine," Year: 2009; p. 118-122.*
(Continued)

*Primary Examiner* — Tuan C. To
(74) *Attorney, Agent, or Firm* — Squire Patton Boggs (US) LLP

(57) ABSTRACT

A rotation type working machine includes: an attachment mounted so as to be able to rotate with respect to a base body; a rotation mechanism which rotates the attachment; a control device which controls the rotation mechanism; and an entering object detection device which detects a position of an entering object entered into a work area, in which the control device controls a rotation operation of the attachment based on a first physical amount related to at least one of a current angular velocity of the attachment and a current moment of inertia of the attachment, and the position of the entering object detected by the entering object detection device.

11 Claims, 12 Drawing Sheets

(51) Int. Cl.
*E02F 3/43* (2006.01)
*E02F 9/24* (2006.01)
*E02F 9/26* (2006.01)

(52) U.S. Cl.
CPC ..... *E02F 9/2054* (2013.01); *E02F 9/24* (2013.01); *E02F 9/265* (2013.01)

(56) References Cited

U.S. PATENT DOCUMENTS

| | | | | |
|---|---|---|---|---|
| 6,786,896 | B1 * | 9/2004 | Madhani | A61B 19/2203 128/898 |
| 8,137,047 | B2 * | 3/2012 | Ishii | B25J 9/0087 414/699 |
| 8,478,492 | B2 * | 7/2013 | Taylor et al. | 701/50 |
| 2005/0000703 | A1 * | 1/2005 | Furuno et al. | 172/2 |
| 2005/0166413 | A1 * | 8/2005 | Crampton | B25J 13/088 33/503 |
| 2005/0253542 | A1 * | 11/2005 | Sugano et al. | 318/371 |
| 2007/0010925 | A1 * | 1/2007 | Yokoyama et al. | 701/50 |
| 2008/0188986 | A1 * | 8/2008 | Hoppe | B25J 9/1692 700/263 |
| 2011/0178677 | A1 * | 7/2011 | Finley | E02F 9/265 701/31.4 |
| 2012/0232763 | A1 * | 9/2012 | Mizuochi | B66C 23/905 701/50 |

FOREIGN PATENT DOCUMENTS

| | | | |
|---|---|---|---|
| JP | 2003-105807 A | | 4/2003 |
| JP | 2006022486 A | * | 1/2006 |
| JP | 2010-198519 A | | 9/2010 |

OTHER PUBLICATIONS

International Search Report dated Jan. 31, 2012 corresponding to International Patent Application No. PCT/JP2011/005836 and English translation thereof.

* cited by examiner

SWING OPERATING MACHINE AND METHOD OF CONTROLLING SWING OPERATING MACHINE

TECHNICAL FIELD

The present invention relates to a rotation type working machine having an attachment which rotates with respect to a base body, and a control method for the rotation type working machine.

BACKGROUND

In a rotation type working machine having an attachment mounted so as to be able to rotate with respect to a traveling body (a base body), when an entry of an entering object into a no-entry area is detected, a control to forcibly stop a rotation operation is performed. A technique to alter a no-entry area based on a type of an entering object, for example, a worker who performs specific work, a general worker, or the like is proposed.

PRIOR ART DOCUMENT

Patent Literature

PTL1: Japanese patent publication No. 2003-105807

SUMMARY

Problems to be Solved by Invention

A range in which the probability of the attachment contacting is high is different according to a current operation of the rotation type working machine. For example, in a case where the attachment rotates at a fast rotation speed, a range in which the probability of the attachment contacting after the start of a stop operation is high is wide, and in a case where the attachment is stationary, a range in which the probability of the attachment contacting is high is narrow. For this reason, if the size of a no-entry area is uniformly determined regardless of a current operation, even in a case where the probability of the attachment contacting is low, a rotation operation may be stopped. On the contrary, in a case where the probability of the attachment contacting is high, a rotation operation may not be stopped.

An object of the present invention is to provide a rotation type working machine and a control method for the rotation type working machine, in which it is possible to perform appropriate control according to the level of the probability of an attachment contacting.

Means of Solving the Problems

According to an aspect of the present invention, there is provided a rotation type working machine including: an attachment mounted so as to be able to rotate with respect to a base body; a rotation mechanism which rotates the attachment; a control device which controls the rotation mechanism; and an entering object detection device which detects a position of an entering object entered into a work area, wherein the control device controls a rotation operation of the attachment based on a first physical amount related to at least one of a current angular velocity of the attachment and a current moment of inertia of the attachment, and the position of the entering object detected by the entering object detection device.

According to another aspect of the present invention, there is provided a control method for a rotation type working machine including: a step of detecting a position of an entering object entered into a working range of the rotation type working machine having a rotatable attachment; and a step of controlling a rotation operation of the attachment based on a first physical amount related to at least one of a current angular velocity of the attachment and a current moment of inertia of the attachment, and the position of the entering object.

Advantageous Effect of Invention

In controlling the rotation of the attachment, the control in response to the probability level of the attachment contacting is able to be performed because the first physical amount is considered.

DETAILED DESCRIPTION

Figure 1:
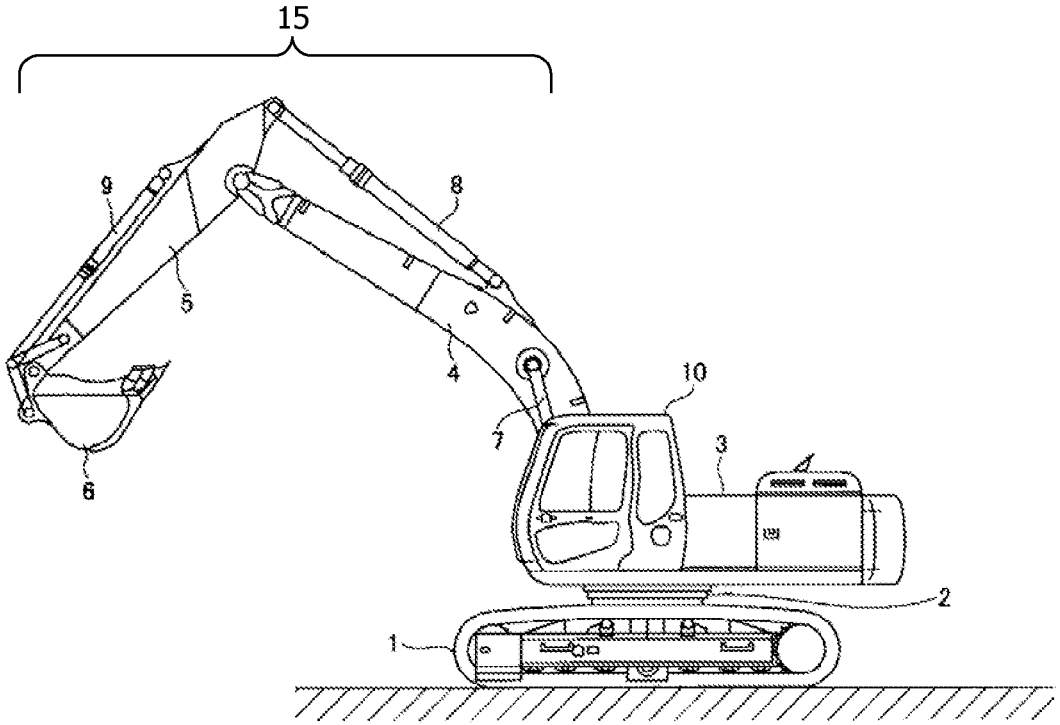
FIG. 1 is a side view of a rotation type working machine according to an embodiment.

In FIG. 1, a side view of an excavator (a rotation type working machine) according to an embodiment is shown. An upper rotating body 3 is mounted on a lower traveling body (a base body) 1 through a rotation mechanism 2. The rotation mechanism 2 includes an electric motor (a motor) and rotates the upper rotating body 3 in a clockwise direction or a counterclockwise direction. A boom 4 is attached to the upper rotating body 3. The boom 4 swings in an up-and-down direction with respect to the upper rotating body 3 by a boom cylinder 7 which is hydraulically driven. An arm 5 is attached to the tip of the boom 4. The arm 5 swings in a front-back direction with respect to the boom 4 by an arm cylinder 8 which is hydraulically driven. A bucket 6 is attached to the tip of the arm 5. The bucket 6 swings with respect to the arm 5 by a bucket cylinder 9 which is hydraulically driven. A cabin 10 which accommodates a driver is further mounted on the upper rotating body 3. In this specification, the boom 4, the arm 5, and the bucket 6 will be collectively referred to as an "attachment" 15.

Figure 2A:
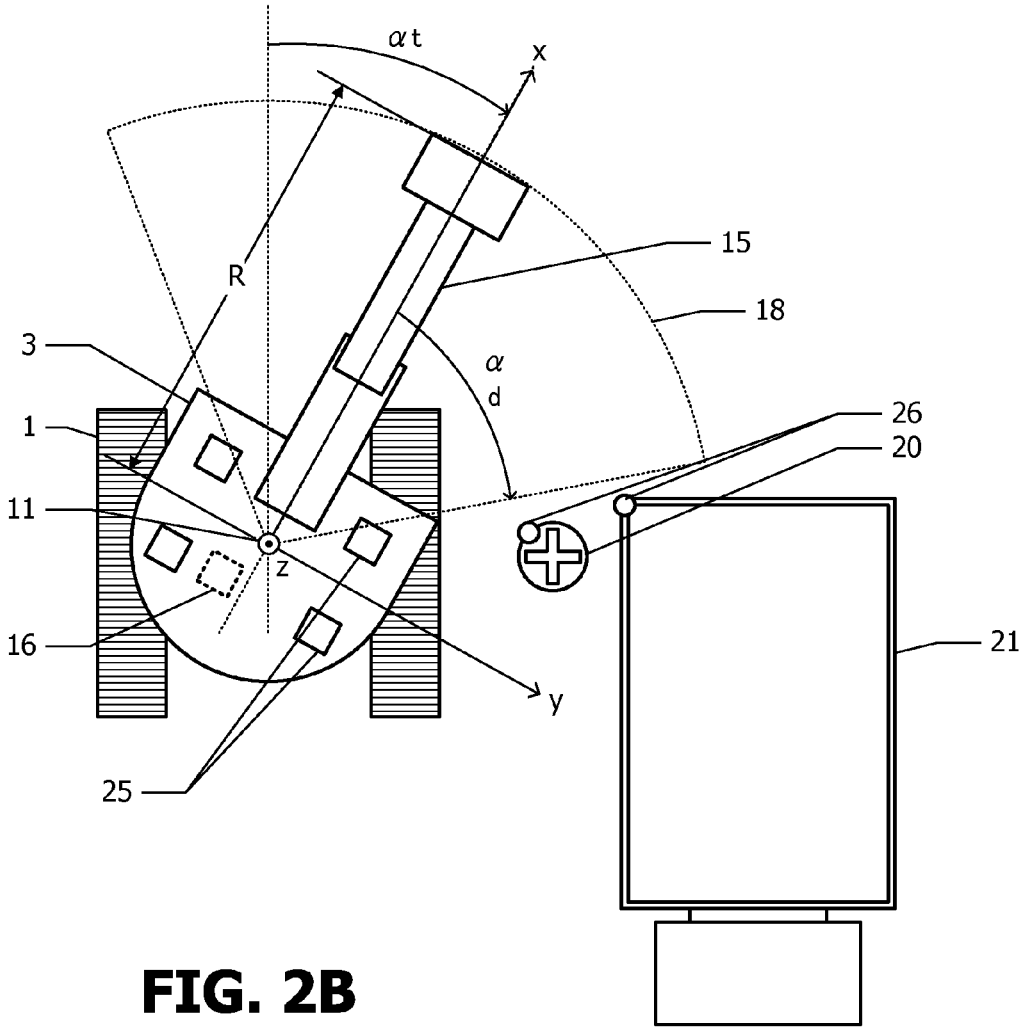
FIG. 2A is a plan view showing planar disposition of the rotation type working machine according to the embodiment, a worker, and a dump truck.

In FIG. 2A, a planar layout diagram of the rotation type working machine according to the embodiment and a worker and a dump truck around the rotation type working machine is shown. The upper rotating body 3 is mounted on the base body 1. The upper rotating body 3 rotates with respect to the base body 1 around a rotation center 11. The attachment 15 is attached to the upper rotating body 3. The attachment 15 rotates around the rotation center 11 along with the upper rotating body 3.

A rotation angle sensor 16 detects a rotation angle from a reference orientation of the upper rotating body 3 with respect to the base body 1. For example, the front in a traveling direction of the base body 1 is set to be the reference orientation. A rotation angle at is defined by the angle between the reference orientation and an orientation in which the attachment 15 extends from the rotation center 11.

When the base body 1 is placed on a reference horizontal plane, an xyz rectangular coordinate system is defined in which an orientation which faces the tip of the attachment 15 from the rotation center 11 on the reference horizontal plane is defined as an x-axis, an orientation orthogonal thereto is defined as a y-axis, and the rotation center 11 is defined as a z-axis. In FIG. 2A, a left-handed system is adopted as xyz rectangular coordinates.

A supervised area 18 is defined by a fan shape centered on the rotation center 11 (the z-axis). The supervised area 18 is line-symmetrical with respect to the center line of the attachment 15 in a plan view. ½ of the central angle of the supervised area 18 will be referred to as a "supervised angle upper limit" $\alpha d$.

A distance R from the rotation center 11 (the z-axis) to the tip of the attachment 15 varies by swinging the boom 4, the arm 5, and the bucket 6. Here, the distance R means a projection length to the reference horizontal plane (an x-y plane). The distance R will be referred to as an "attachment length". The radius of the supervised area 18 is equal to the attachment length R.

A plurality of, for example, four entering object detection devices 25 are mounted on the upper rotating body 3. A transmitter 26 is attached to a helmet of a worker 20, a dump truck 21, or the like. For example, when the dump truck 21 enters into a working site, the transmitter 26 is attached to a predetermined place of the dump truck 21 at an entrance. When the dump truck 21 exits from the working site, the transmitter 26 is removed from the dump truck 21. As an example, the transmitter 26 is attached to a rearmost corner on the rotation type working machine side of a load-carrying platform of the dump truck 21. In addition, a plurality of transmitters 26 may be attached to the dump truck 21.

As the transmitter 26, for example, an omni-directional marker light emitter is used. As the entering object detection device 25, for example, a CCD camera which acquires an image of the transmitter 26 is used. By imaging one transmitter 26 by the plurality of entering object detection devices 25, it is possible to calculate the position of the transmitter 26. Since the entering object detection devices 25 are mounted on the upper rotating body 3, the calculated position of the transmitter 26 is detected as a position relative to the upper rotating body 3.

Figure 2B:
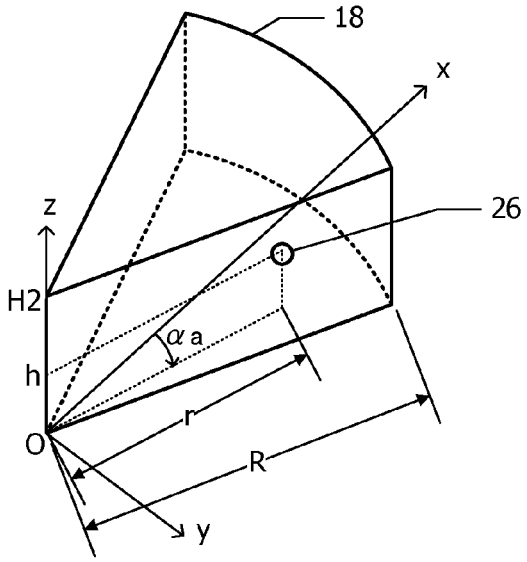
FIG. 2B is a perspective view showing a supervised area.

In FIG. 2B, a three-dimensional perspective view of the supervised area 18 and the transmitter 26 is shown. The supervised area 18 is a right prism (right cylinder) having a fan-shaped bottom surface. The height of the supervised area 18 is equal to a maximum arrival height H2 of the attachment 15. The radius of the fan shape is equal to the attachment length R. The position of the transmitter 26 is expressed by an azimuth angle $\alpha a$ based on the x-axis, a distance r from the z-axis, and a height h from the x-y plane.

Figure 3:
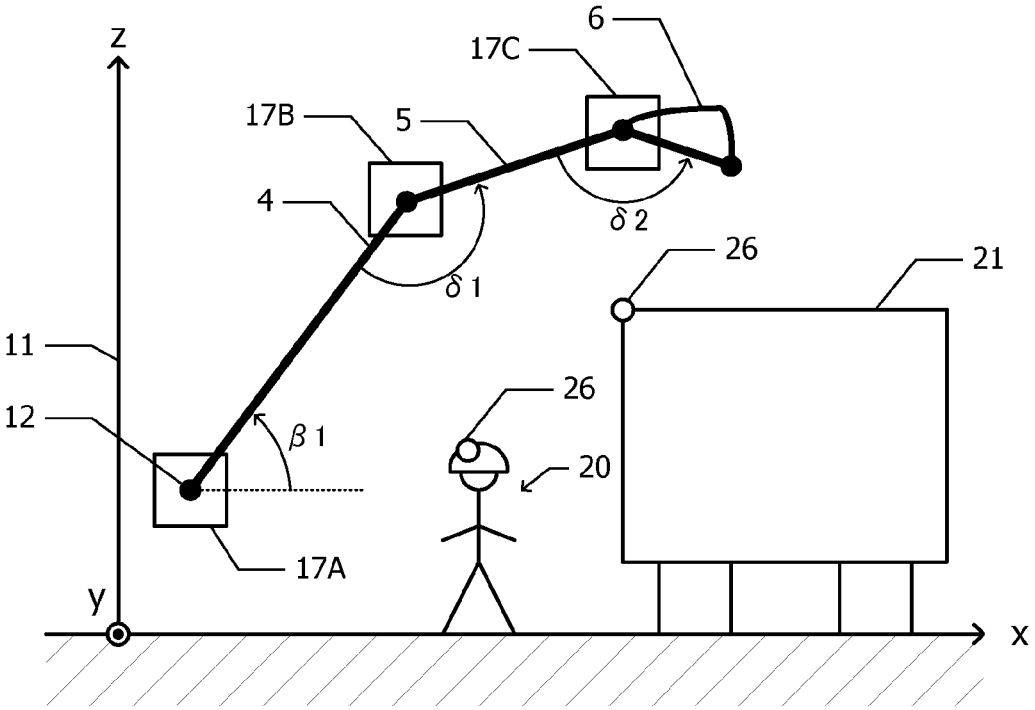
FIG. 3 is a schematic diagram showing the positional relationship in a height direction and a lateral direction between the rotation type working machine according to the embodiment, the worker, and the dump truck.

In FIG. 3, the positional relationship in a height direction and a lateral direction between the attachment 15, the worker 20, and the dump truck 21 is shown. The transmitter 26 is attached to a helmet that the worker 20 wears. The transmitter 26 is attached at the highest position of the load-carrying platform of the dump truck 21.

The boom 4 swings up and down around a swing center 12 parallel to the y-axis. The arm 5 is attached to the tip of the boom 4 and the bucket 6 is attached to the tip of the arm 5. Up-and-down angle sensors 17A, 17B, and 17C are respectively mounted on a base portion of the boom 4, a connection portion between the boom 4 and the arm 5, and a connection portion between the arm 5 and the bucket 6. The up-and-down angle sensor 17A measures an angle $\beta 1$ between a longitudinal direction of the boom 4 and the reference horizontal plane (the x-y plane). The up-and-down angle sensor 17B measures an angle $\delta 1$ between the longitudinal direction of the boom 4 and a longitudinal direction of the arm 5. The up-and-down angle sensor 17C measures an angle $\delta 2$ between the longitudinal direction of the arm 5 and a longitudinal direction of the bucket 6. Here, the longitudinal direction of the boom 4 means a direction of a straight line passing through the swing center 12 and the connection portion between the boom 4 and the arm 5 in a plane (a z-x plane) perpendicular to the swing center 12. The longitudinal direction of the arm 5 means a direction of a straight line passing through the connection portion between the boom 4 and the arm 5 and the connection portion between the arm 5 and the bucket 6 in the z-x plane. The longitudinal direction of the bucket 6 means a direction of a straight line passing through the connection portion between the arm 5 and the bucket 6 and the tip of the bucket 6 in the z-x plane.

The swing center 12 is disposed at a position deviated from the rotation center 11 (the z-axis). Instead, a structure may be adopted in which the rotation center 11 and the oscillation center 12 cross each other.

Figure 4:
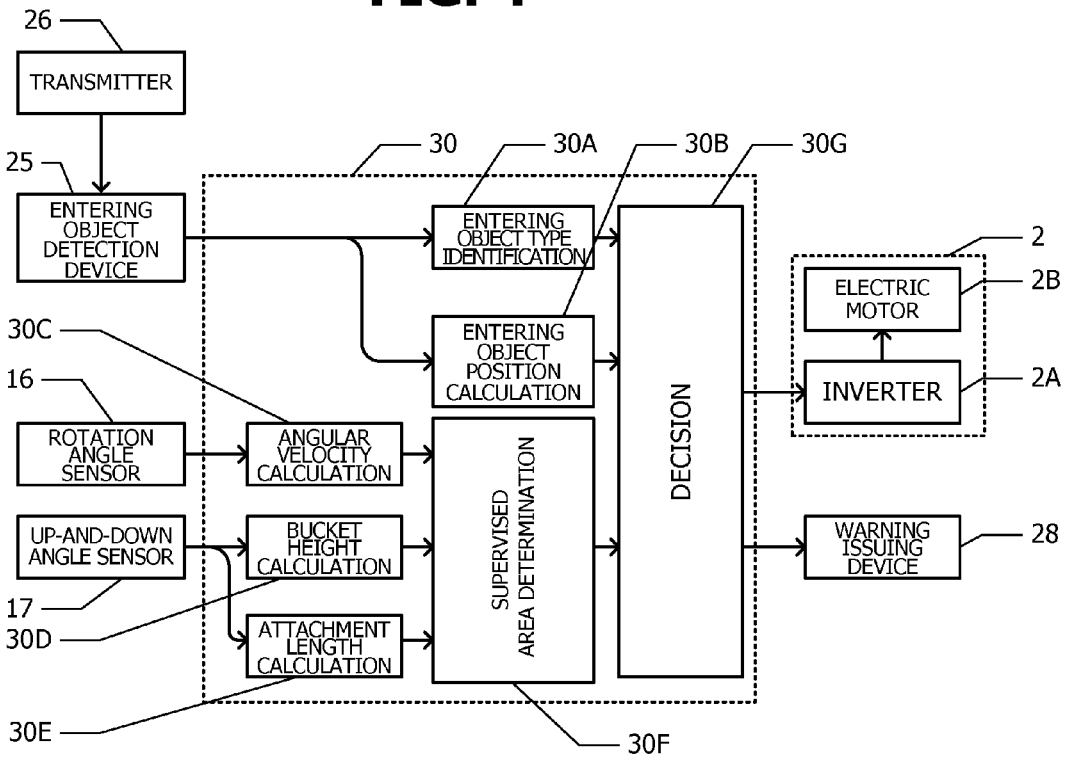
FIG. 4 is a block diagram of the rotation type working machine according to the embodiment.

In FIG. 4, a block diagram of the rotation type working machine is shown. The entering object detection device 25 images the transmitter 26. Image data imaged by the entering object detection device 25, a measurement result of the rotation angle sensor 16, and a measurement result of the up-and-down angle sensor 17 are input to a control device 30. The control device 30 includes an entering object type identification block 30A, an entering object position calculation block 30B, an angular velocity calculation block 30C, a bucket height calculation block 30D, an attachment length calculation block 30E, a supervised area determination block 30F, and a decision block 30G. The function of each of these blocks is realized by a computer program.

The entering object type identification block 30A specifies the type of an entering object by analyzing the image data input from the entering object detection device 25. For example, the colors of light from the transmitter 26 which is attached to the worker and light from the transmitter 26 which is attached to the dump truck are different from each other. Whether the entering object is the worker or the dump truck can be identified by identifying the color of an image of the transmitter 26.

The entering object position calculation block 30B calculates the position of the entering object by analyzing the image data input from the entering object detection device 25. Specifically, the coordinates (αa, r, h) of the transmitter 26 shown in FIG. 2B are calculated.

The angular velocity calculation block 30C calculates angular velocity ω of the attachment 15 based on a variation of a rotation angle input from the rotation angle sensor 16.

The bucket height calculation block 30D calculates a height Hb of the tip of the bucket 6 based on the measurement result input from the up-and-down angle sensor 17. The attachment length calculation block 30E calculates the attachment length R based on the measurement result input from the up-and-down angle sensor 17.

Figure 5:
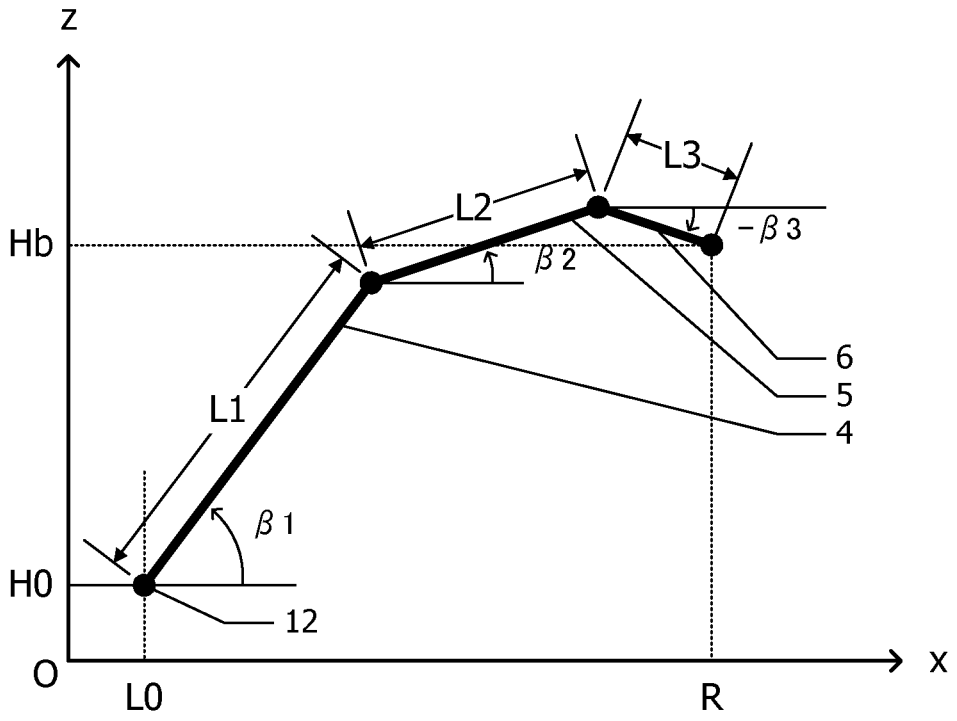
FIG. 5 is a schematic diagram of an attachment.

A method of calculating the bucket height Hb and the attachment length R will be described with reference to FIG. 5. The lengths of the boom 4, the arm 5, and the bucket 6 are respectively referred to as L1, L2, and L3. The angle β1 between the reference horizontal plane (the x-y plane) and the longitudinal direction of the boom 4 is measured by the up-and-down angle sensor 17A (FIG. 3). The angle δ1 (FIG. 3) between the boom 4 and the arm 5 and the angle δ2 (FIG. 3) between the arm 5 and the bucket 6 are respectively measured by the up-and-down angle sensors 17B and 17C. A height H0 from the x-y plane to the swing center 12 is obtained in advance. Further, a distance L0 from the rotation center 11 (the z-axis) to the swing center 12 is also obtained in advance.

An angle β2 between the x-y plane and the longitudinal direction of the arm 5 can be calculated from the angle β1 and the angle δ1. An angle β3 between the x-y plane and the longitudinal direction of the bucket 6 can be calculated from the angle β1 and the angles δ1 and δ2. The bucket height Hb and the attachment length R can be calculated by the following equations.

$$Hb=H0+L1\cdot\sin\beta1+L2\cdot\sin\beta2+L3\cdot\sin\beta3$$

$$R=L0+L1\cdot\cos\beta1+L2\cdot\cos\beta2+L3\cdot\cos\beta3 \qquad \text{[Equation 1]}$$

As described above, the attachment length R and the bucket height Hb can be calculated based on physical amounts measured by the up-and-down angle sensors 17A, 17B, and 17C. The bucket height Hb is equivalent to the height of the tip of the attachment 15 using the x-y plane as a reference of a height. The angles which are measured by the up-and-down angle sensors 17A, 17B, and 17C are thought to be a physical amount (a second physical amount) related to the height of the tip of the attachment 15.

The supervised area determination block 30F determines the size of the supervised area 18 based on the angular velocity ω of the attachment 15 calculated in the angular velocity calculation block 30C, the bucket height Hb calculated in the bucket height calculation block 30D, and the attachment length R calculated in the attachment length calculation block 30E. As shown in FIGS. 2A and 2B, the supervised area 18 can be defined based on the attachment length R, the maximum arrival height H2 of the attachment 15, and the supervised angle upper limit αd. The attachment length R is already obtained. The maximum arrival height H2 is a value peculiar to the working machine and is already obtained. Hereinafter, how to obtain the supervised angle upper limit αd will be described with reference to FIGS. 6, 7A, and 7B.

Figure 6:
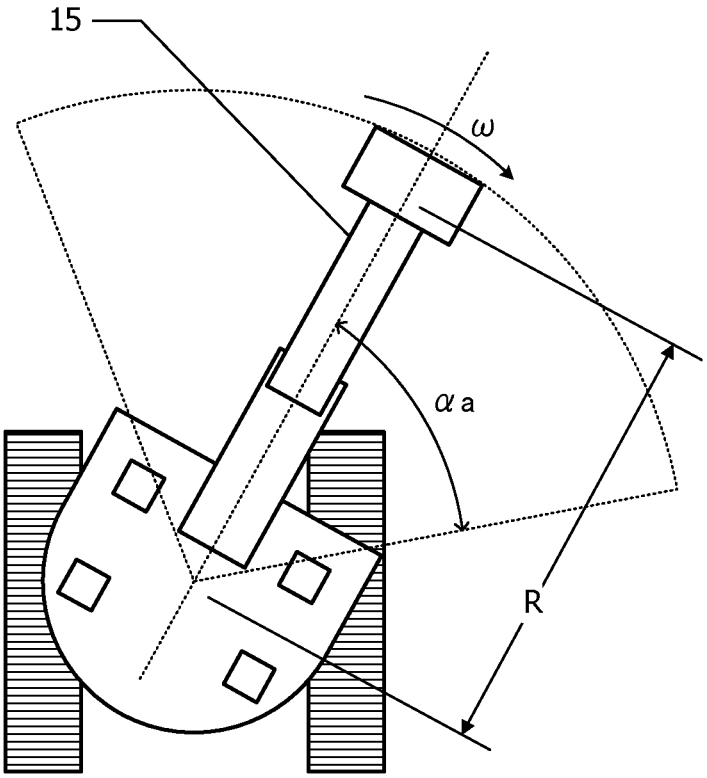
FIG. 6 is a plan view of the rotation type working machine according to the embodiment and the supervised area.

As shown in FIG. 6, it is assumed that the current angular velocity of the attachment 15 is ω and the attachment length is R. In the embodiment, the supervised angle upper limit αd varies depending on the angular velocity ω and the attachment length R. An angle (a braking angle) at which the attachment 15 rotates after a brake for stopping rotation is operated and until the attachment 15 stops depends on the angular velocity ω of the attachment 15. As the angular velocity ω increases, the braking angle becomes large, and therefore, it is preferable to set the supervised angle upper limit αd to be large. On the contrary, in a case where the angular velocity ω is small, the supervised angle upper limit αd is allowed to be set to be small.

The braking angle also depends on the moment of inertia of the attachment 15. The moment of inertia depends on the attachment length R, and the moment of inertia increases as the attachment length R becomes longer. That is, the attachment length R is a physical amount (a first physical amount) related to the moment of inertia of the attachment. Therefore, in a case where the attachment length R is long, it is preferable to set the supervised angle upper limit αd to be large. On the contrary, in a case where the attachment length R is short, the supervised angle upper limit αd is allowed to be set to be small.

Figure 7A:
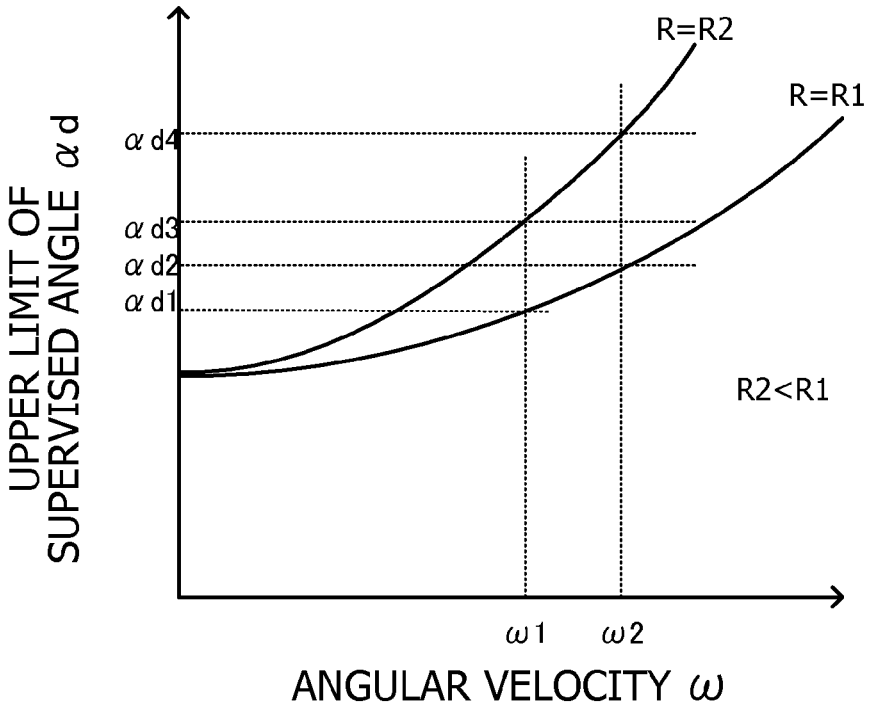
FIG. 7A is a graph showing the relationship between angular velocity and a supervised angle upper limit.
Figure 7B:
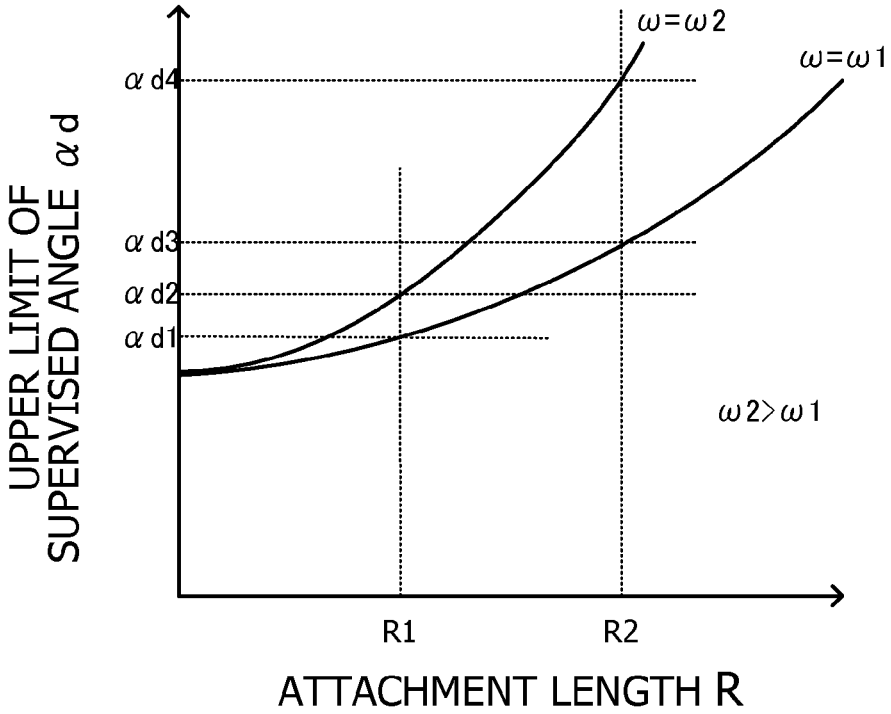
FIG. 7B is a graph showing the relationship between an attachment length and a supervised angle upper limit.
Figure 8A:
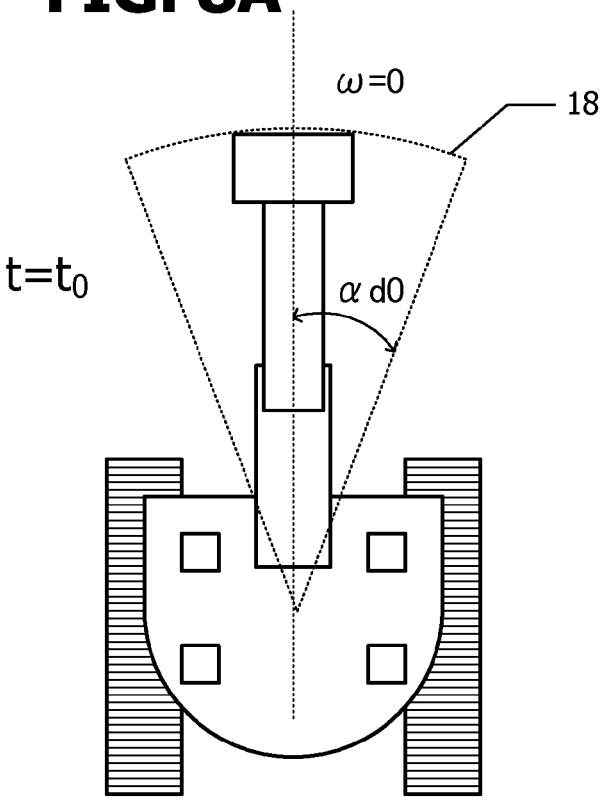
FIGS. 8A and 8B are plan views of the rotation type working machine according to the embodiment and the supervised area.
Figure 8B:
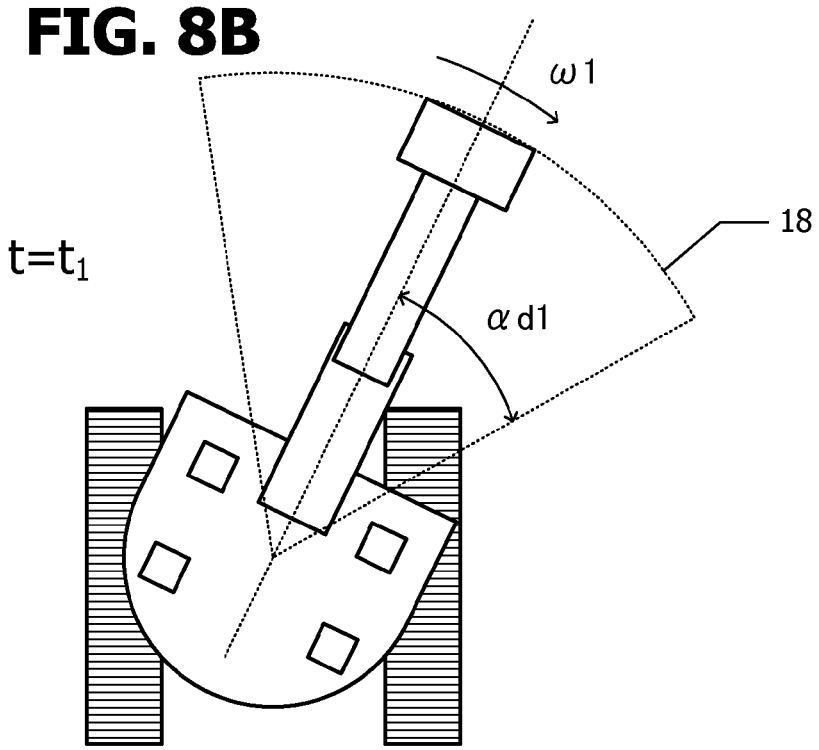
Figure 8C:
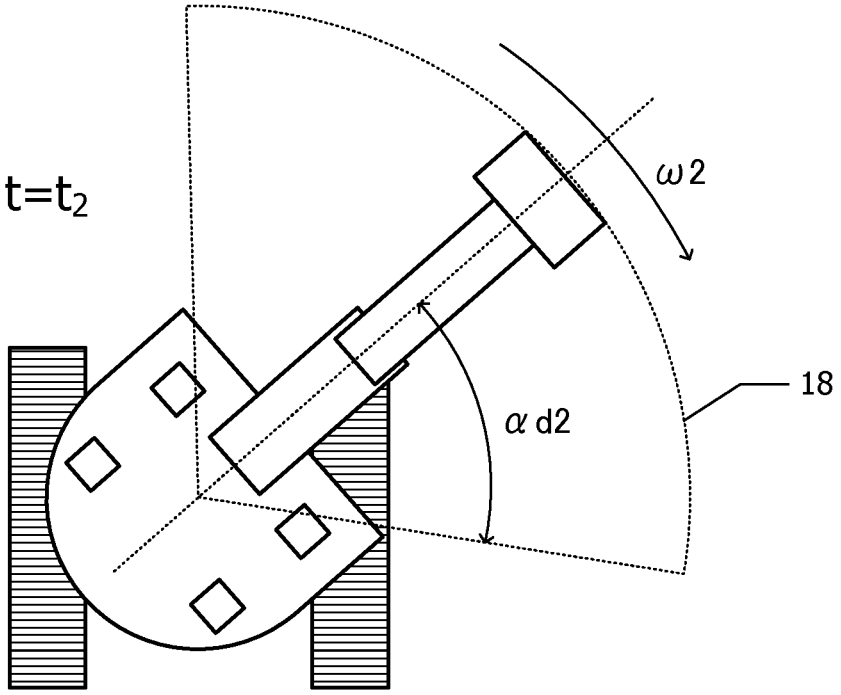
FIGS. 8C and 8D are plan views of the rotation type working machine according to the embodiment and the supervised area.
Figure 8D:
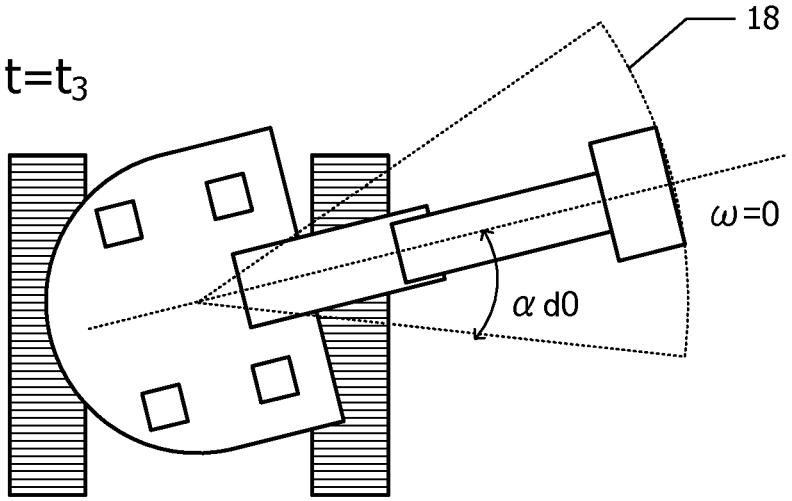

In FIG. 7A, the relationship between the angular velocity ω and the supervised angle upper limit αd is shown with the attachment length R as a parameter. In FIG. 7B, the relationship between the attachment length R and the supervised angle upper limit αd is shown with the angular velocity ω as a parameter. In a case where the attachment length R is constant, the supervised angle upper limit αd is set so as to become larger as the angular velocity ω increases. In a case where the angular velocity ω is constant, the supervised angle upper limit αd is set so as to become larger as the attachment length R becomes longer.

The relationship among the angular velocity ω, the attachment length R, and the supervised angle upper limit αd are determined in advance and stored in the supervised area determination block 30F. The relationship may be stored in a table form and may also be stored in a functional form. In a case of being stored in a table form, the supervised angle upper limit αd can be obtained from the angular velocity ω and the attachment length R by performing an appropriate interpolation calculation. In a case of being stored in a functional form, the supervised angle upper limit αd can be directly calculated from the angular velocity ω and the attachment length R.

An example of a variation of the supervised angle upper limit αd after the attachment 15 starts to rotate until the attachment 15 stops will be described with reference to FIGS. 8A to 9B.

Figure 9A:
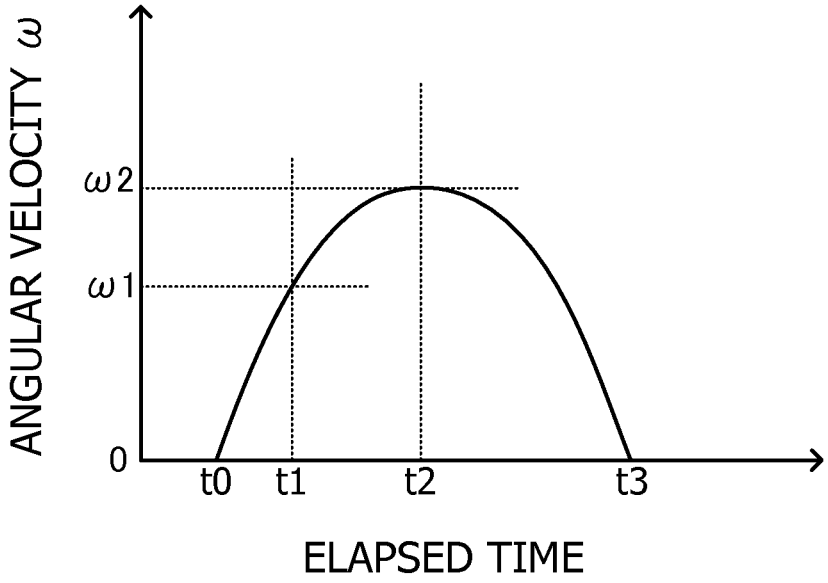
FIG. 9A is a graph showing time history of the angular velocity.

In FIG. 9A, the relationship between elapsed time and the angular velocity ω is shown. A rotation operation is started at time t0 and the angular velocity ω gradually increases. The angular velocity becomes ω1 at time t1 and reaches a maximum angular velocity ω2 at time t2. Then, the angular velocity ω becomes slow and the rotation operation stops at time t3.

Figure 9B:
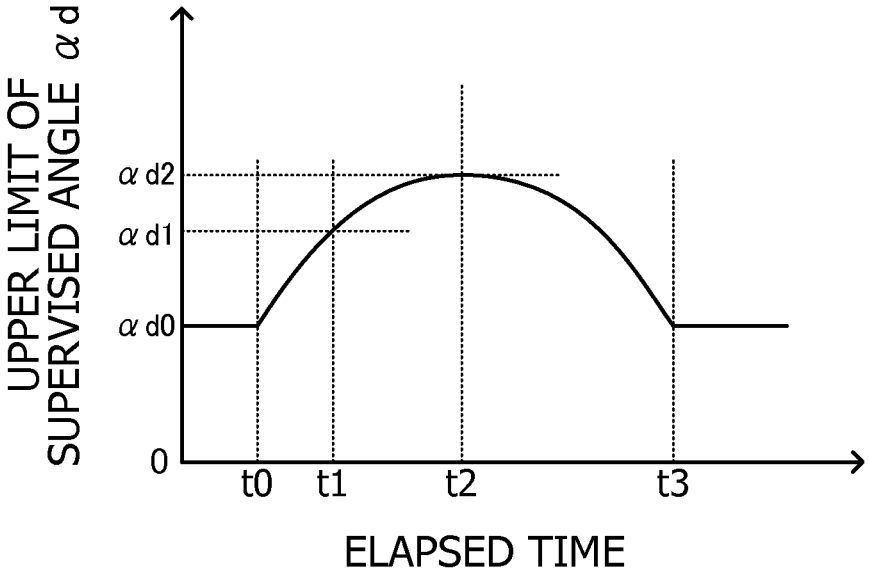
FIG. 9B is a graph showing time history of the supervised angle upper limit.

In FIG. 9B, the relationship between elapsed time and the supervised angle upper limit αd is shown. At the times t0 and t3, that is, when the angular velocity ω is 0, the supervised angle upper limit αd is αd0. The supervised angle upper limits αd at the time t1 and the time t2 are respectively αd1 and αd2. The magnitude relationship between these supervised angle upper limits is the relationship of αd0<αd1<αd2.

In FIGS. 8A, 8B, 8C, and 8D, plan views of the rotation type working machine and the supervised area 18 at the times t0, t1, t2, and t3 are respectively shown. The central angle of the supervised area 18 becomes larger as the angular velocity ω becomes faster.

Figure 10A:
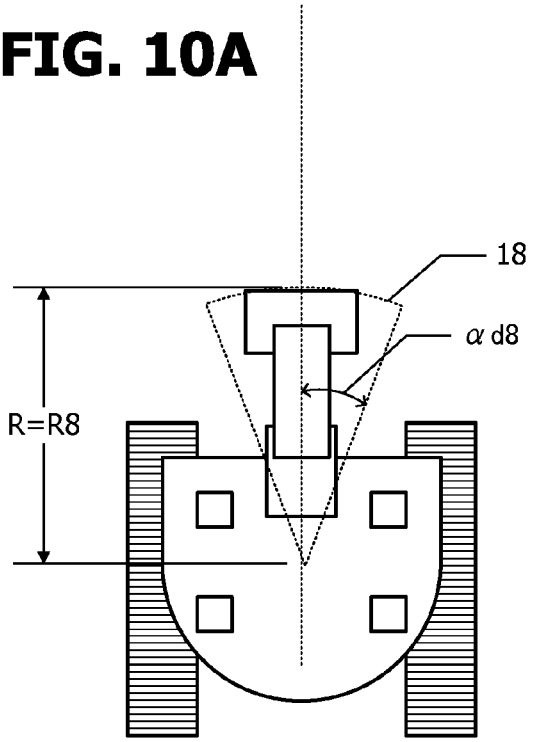
FIGS. 10A and 10B are plan views of the rotation type working machine according to the embodiment and the supervised area.
Figure 10B:
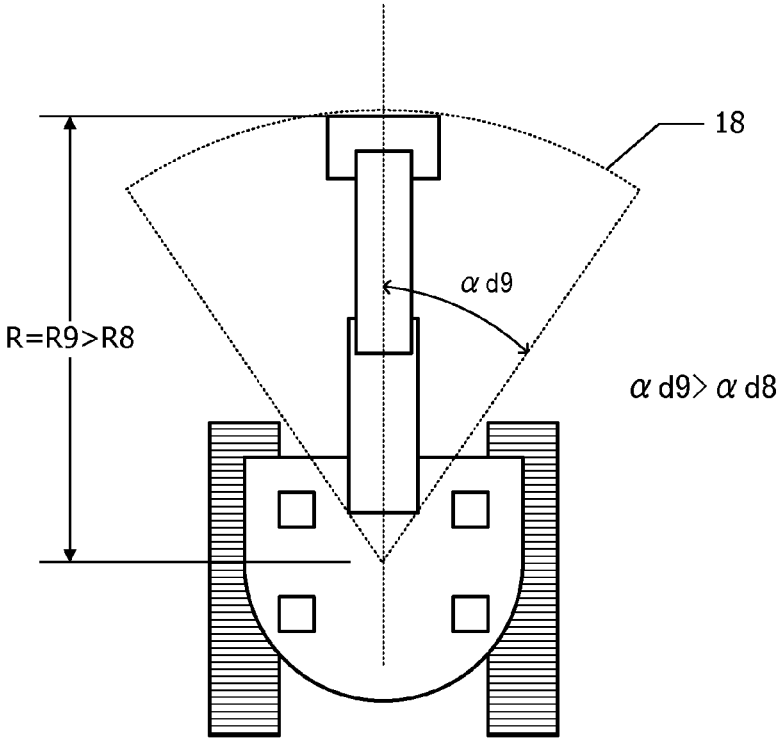

In FIGS. 10A and 10B, the supervised areas 18 when the attachment length R is R8 and R9 (R8<R9) are respectively shown. If the attachment length R is increased from R8 to R9, the radius of the fan shape of the supervised area 18 is also increased from R8 to R9. In addition, half (the supervised angle upper limit) of the central angle of the supervised area 18 is also increased from αd8 to αd9.

Returning to FIG. 4, the description is continued. The decision block 30G decides whether or not it is in a state where the probability of contact is high, based on the type of the entering object determined in the entering object type identification block 30A, the position of the entering object determined in the entering object position calculation block 30B, and the size of the supervised area 18 determined in the supervised area determination block 30F. A decision method will be described with reference to a flowchart of FIG. 11 later.

In a case where it is decided that it is in a state where the probability of contact is high, first control is performed, and in a case where it is decided that it is in a state where the probability of contact is low, second control is performed. For example, in the first control, the stop of a rotation operation is commanded to the rotation mechanism 2. The rotation mechanism 2 includes, for example, an inverter 2A and an electric motor 2B. The stop of a rotation operation is commanded by a control signal which is transmitted to the inverter 2A. In addition, a warning such as warning sound or light is issued from a warning issuing device 28. In the second control, the rotation operation of the attachment 15 is continued.

Figure 11:
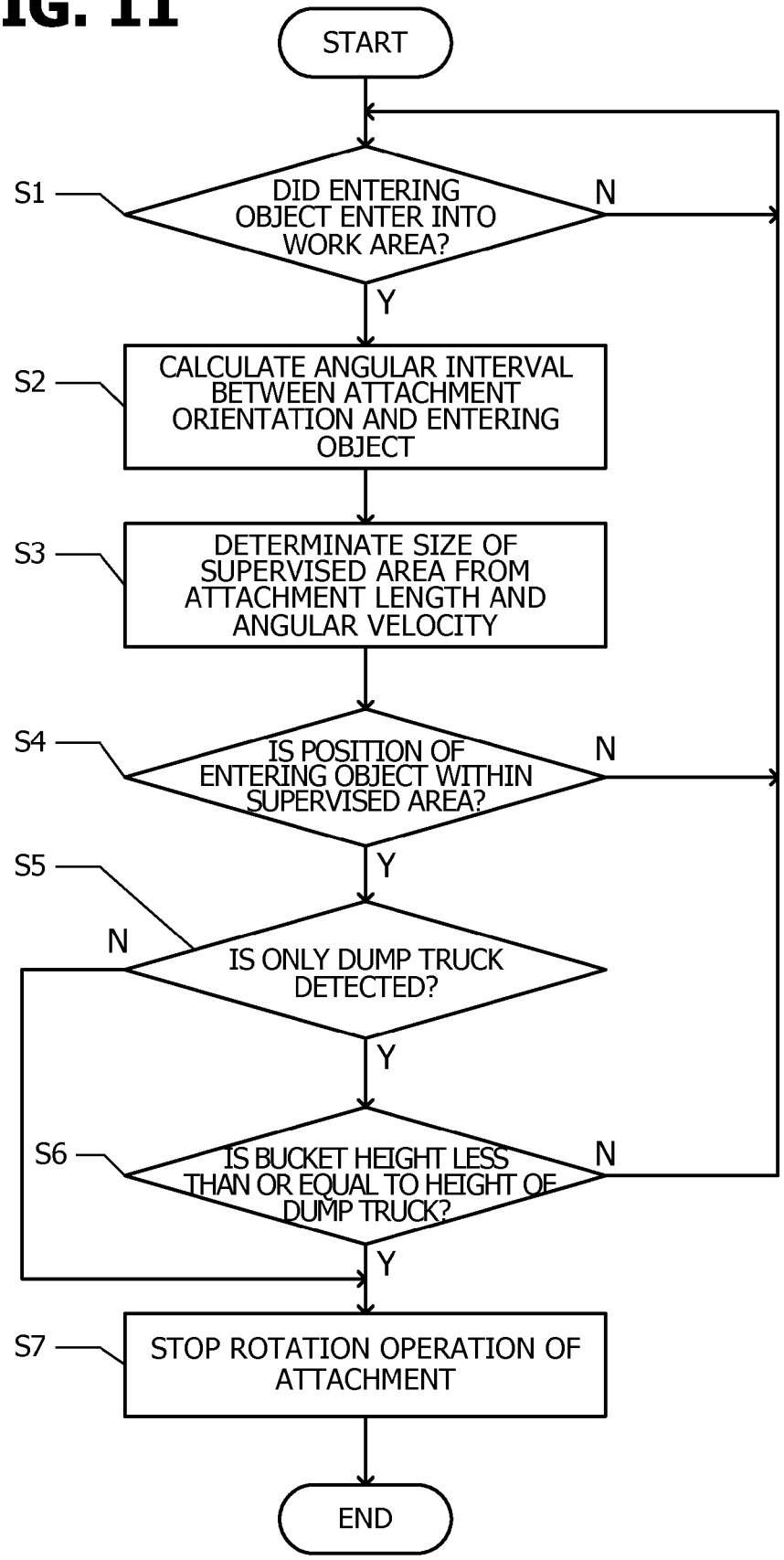
FIG. 11 is a flowchart of a control method according to the embodiment.

In FIG. 11, a flowchart of a control method for the rotation type working machine according to the embodiment is shown. After an operation of the rotation type working machine is started, in Step S1, whether or not an entering object has entered into a work area is decided. This decision processing is performed in the decision block 30G (FIG. 4). For example, in a case where the distance r to the transmitter 26 shown in FIG. 2B is shorter than the maximum value of the attachment length R, the entering object is decided to be entered into the work area. In a case where the entering object does not enter into the work area, the process returns to Step S1.

In a case where the entering object is decided to be entered into the work area, in Step S2, the angle (the angular interval) between the orientation (the x-axis) in which the attachment 15 extends and an orientation indicating the position of the entering object is calculated. Specifically, the azimuth angle αa indicating the position of the transmitter shown in FIG. 2B corresponds to the angular interval. Calculation of the angular interval is performed in the decision block 30G (FIG. 4).

In Step S3, the size of the supervised area 18 is determined based on the attachment length R and the angular velocity ω. In this manner, the attachment length R and the angular velocity ω are used as the physical amount (the first physical amount) which becomes a basis for determining the size of the supervised area 18. The determination of the size of the supervised area 18 is performed in the supervised area determination block 30F (FIG. 4). The size of the supervised area 18 is specified by the supervised angle upper limit αd and the radius R (FIG. 2B).

In Step S4, whether or not at least one entering object has entered into the supervised area 18 is decided. This decision and the subsequent Steps S5 to S7 are performed in the decision block 30G (FIG. 4). Specifically, in a case where the angular interval (the azimuth angle αa indicating the position of the entering object) between the x-axis and the entering object is less than or equal to the supervised angle upper limit αd and the distance r to the entering object is less than or equal to the attachment length R, the entering object is decided to be entered into the supervised area 18.

In Step S5, whether or not only a dump truck is detected as an entering object is decided. In a case where only a dump truck is detected as the entering object, in Step S6, a comparison between the bucket height Hb and the height of the dump truck is made. In a case where the bucket height Hb is higher than the height of the dump truck, the process returns to Step S1. In this case, since the probability of contact is low, it is not necessary to stop the rotation operation. For example, the rotation operation is continued, and thus the bucket 6 is moved above the load-carrying platform of the dump truck and work to transfer the object retained in the bucket 6 into the dump truck is performed.

In a case where the bucket height Hb is less than or equal to the height of the dump truck and a case where a decision that the entering object type of the entering objects is not only the dump truck is made in Step S5, Step S7 is executed. In Step S7, the rotation operation of the attachment 15 is stopped. In this way, it is possible to avoid the contact between the attachment and the entering object.

In the method according to the embodiment, in a case where the angular velocity ω of the attachment 15 is fast and a case where the moment of inertia is large, the supervised area 18 is set to be wide. For this reason, it is possible to avoid contact with ample room. On the contrary, in a case where the angular velocity ω of the attachment 15 is slow and a case where the moment of inertia is small, the supervised area 18 is set to be narrow. For this reason, it is possible to avoid unnecessary work stoppage in a case where the probability of contact is low. In this way, work efficiency can be prevented from being decreased.

In the embodiment described above, the size of the supervised area 18 is changed based on both the angular velocity ω of the attachment 15 and the attachment length related to the moment of inertia. In actual control, the size of the supervised area 18 may be changed based on any one, that is, the physical amount (the first physical amount) related to at least one of the angular velocity of the attachment and the moment of inertia of the attachment.

In the embodiment described above, the orientation facing the tip of the attachment 15 from the rotation center of the attachment 15 is referred to as the x-axis. However, another coordinate system may be used as the xyz rectangular coordinate system. For example, the front orientation of the lower traveling body 1 (FIGS. 1 and 2A) may be defined as the x-axis. In a case where the entering object detection device 25 is mounted on the lower traveling body 1, this coordinate system is convenient. Further, the x-axis and the y-axis may be defined by using the terrestrial reference coordinate system (longitude and latitude). For example, a northward direction may be defined as the x-axis. In a case where the position of the entering object is measured by the GPS, this coordinate system is convenient.

The present invention has been described above along the embodiment. However, the present invention is not limited thereto. For example, it will be apparent to those skilled in the art that various modifications, improvements, combinations, and the like can be made.

EXPLANATION OF REFERENCES

1 travelling body (base body)
2 rotation mechanism
3 upper rotating body
4 boom
5 arm
6 bucket
7 boom cylinder
8 arm cylinder
9 bucket cylinder
10 cabin
11 rotation center
12 swing center
15 attachment
16 rotation angle sensor
17 up-and-down angle sensor
18 supervised area
20 worker
21 dump truck
25 entering object detection device (camera)
26 transmitter
28 warning issuing device

What is claimed is:

1. A rotation type working machine comprising:

an attachment mounted so as to be able to rotate with respect to a base body;

a rotation mechanism which rotates the attachment;

a control device which controls the rotation mechanism; and an entering object detection device which detects a position of an entering object entered into a work area, wherein the control device controls a rotation operation of the attachment by the rotation mechanism based on a first physical amount related to at least one of a current angular velocity of the attachment and a current moment of inertia of the attachment, and the position of the entering object detected by the entering object detection device, and wherein the control device performs a decision of whether or not probability of contact of the attachment with the entering object is high, based on the first physical amount and the position of the entering object detected by the entering object detection device, performs, in a case where it is decided that the probability of contact is high, first control, and performs, in a case where it is decided that the probability of contact is low, second control different from the first control.

2. A rotation type working machine comprising:

an attachment mounted so as to be able to rotate with respect to a base body;

a rotation mechanism which rotates the attachment;

a control device which controls the rotation mechanism; and an entering object detection device which detects a position of an entering object entered into a work area, wherein the control device controls a rotation operation of the attachment based on a first physical amount related to at least one of a current angular velocity of the attachment and a current moment of inertia of the attachment, and the position of the entering object detected by the entering object detection device, and wherein the control device stores the relationship between an upper limit of a supervised angle and the first physical amount therein, compares an angular interval which is an angle between a current orientation of the attachment with a rotation center of the attachment as a base point and an orientation of the entering object detected by the entering object detection device with the upper limit of the supervised angle, and stops a rotation of the attachment in a case where the angular interval is smaller than the upper limit of the supervised angle.

3. The rotation type working machine according to claim 2, wherein the control device determines the upper limit of the supervised angle such that the upper limit of the supervised angle becomes larger as the current angular velocity of the attachment becomes faster.

4. The rotation type working machine according to claim 2, further comprising:

a sensor which measures a second physical amount related to a height of a tip of the attachment, wherein the entering object detection device is adopted to detect whether or not only a dump truck is detected as the entering object, and the control device allows, in a case where only a dump truck is detected as the entering object and the height of the tip of the attachment is higher than a height of the detected dump truck, a rotation of the attachment even if the angular interval is less than or equal to the upper limit of the supervised angle.

5. A control method for a rotation type working machine comprising:

detecting a position of an entering object entered into a working range of the rotation type working machine having a rotatable attachment;

performing a decision of whether or not probability of contact of the attachment with the entering object is high, based on a first physical amount related to at least one of a current angular velocity of the attachment and a current moment of inertia of the attachment, and the position of the entering object;

performing, in a case where it is decided that the probability of contact is high, first control; and performing, in a case where it is decided that the probability of contact is low, second control different from the first control.

6. A control method for a rotation type working machine comprising:

detecting a position of an entering object entered into a working range of the rotation type working machine having a rotatable attachment; and controlling a rotation operation of the attachment based on a first physical amount related to at least one of a current angular velocity of the attachment and a current moment of inertia of the attachment, and the position of the entering object, wherein in detecting a position of an entering object, an angle between a current orientation of the attachment with a rotation center as a base point and an orientation of the detected entering object is obtained as an angular interval, and the controlling a rotation operation of the attachment includes determining an upper limit of a supervised angle based on the first physical amount, comparing the angular interval with the upper limit of the supervised angle, and controlling the rotation operation of the attachment based on a comparison result of the angular interval with the upper limit of the supervised angle.

7. The control method for a rotation type working machine according to claim 6, wherein in determining an upper limit of a supervised angle, the upper limit of the supervised angle is determined such that the upper limit of the supervised angle becomes larger as the current angular velocity of the attachment becomes faster.

8. The control method for a rotation type working machine according to claim 6, wherein in controlling a rotation operation of the attachment, the rotation operation of the attachment is stopped in a case where the angular interval is less than or equal to the upper limit of the supervised angle.

9. The control method for a rotation type working machine according to claim 8, wherein the controlling a rotation operation of the attachment further includes performing a decision of whether or not only a dump truck is detected as the entering object entered into the working range, detecting a height of a tip of the attachment, and allowing, in a case where the height of the tip of the attachment is higher than a height of the detected dump truck and only a dump truck is detected as the entering object, the rotation operation of the attachment even if the angular interval is less than or equal to the upper limit of the supervised angle.

10. A rotation type working machine comprising:

an attachment mounted so as to be able to rotate with respect to a base body;

a rotation mechanism which rotates the attachment;

a control device which controls the rotation mechanism; and an entering object detection device which detects a position of an entering object entered into a work area, wherein the control device calculates a length of the attachment and controls a rotation operation of the attachment based on a calculated length of the attachment related to a moment of inertia of the attachment, and the position of the entering object detected by the entering object detection device.

11. A rotation type working machine comprising:

an attachment mounted so as to be able to rotate with respect to a base body;

a rotation mechanism which rotates the attachment;

a control device which controls the rotation mechanism; and an entering object detection device which detects a position of an entering object entered into a work area and images the entering object, wherein the control device specifies a type of the entering object by analyzing an image data imaged by the entering object detection device, and controls a rotation operation of the attachment based on a first physical amount related to at least one of a current angular velocity of the attachment and a current moment of inertia of the attachment, the position of the entering object detected by the entering object detection device, and the specified type of the entering object.

* * * * *